US010986879B2

(12) United States Patent
Hatcher

(10) Patent No.: US 10,986,879 B2
(45) Date of Patent: Apr. 27, 2021

(54) HANDS-FREE ADJUSTABLE BIB FOR SECURING A CONTAINER

(71) Applicant: Sheila Hatcher, Gardena, CA (US)

(72) Inventor: Sheila Hatcher, Gardena, CA (US)

( * ) Notice: Subject to any disclaimer, the term of this patent is extended or adjusted under 35 U.S.C. 154(b) by 103 days.

(21) Appl. No.: 16/321,354

(22) PCT Filed: Jul. 31, 2017

(86) PCT No.: PCT/IB2017/054678
§ 371 (c)(1),
(2) Date: Jan. 28, 2019

(87) PCT Pub. No.: WO2018/020486
PCT Pub. Date: Feb. 1, 2018

(65) Prior Publication Data

US 2019/0159526 A1 May 30, 2019

Related U.S. Application Data

(60) Provisional application No. 62/368,399, filed on Jul. 29, 2016.

(51) Int. Cl.
*A41B 13/00* (2006.01)
*A41B 13/10* (2006.01)
*A61J 9/06* (2006.01)

(52) U.S. Cl.
CPC ..... *A41B 13/103* (2013.01); *A41B 13/10* (2013.01); *A61J 9/0607* (2015.05); *A61J 9/0638* (2015.05); *A61J 9/0669* (2015.05)

(58) Field of Classification Search
CPC .... A41B 13/103; A41B 13/10; A61J 19/0607; A61J 9/0607; A61J 9/0638; A61J 9/0669
See application file for complete search history.

(56) References Cited

U.S. PATENT DOCUMENTS 2,134,746 A * 11/1938 Allen ..... A61J 9/0684 248/102
2,526,121 A * 10/1950 Curry ..... A61J 9/0669 248/102
D211,435 S * 6/1968 Kausen ..... D24/199
4,809,938 A * 3/1989 Skinner ..... A61J 9/0607 248/102
4,895,327 A * 1/1990 Malone ..... A61J 9/0607 248/102
5,022,616 A * 6/1991 Kordecki ..... A61J 9/0638 248/106
5,072,843 A * 12/1991 James ..... A61J 9/0607 215/11.1

(Continued)

*Primary Examiner* — Richale L Quinn

(57) ABSTRACT

A hands-free adjustable bib includes a bib, a support plate, a pair of hand shaped holders, and a container adjustment assembly. The pair of hand shaped holders is adjustably connected to the container adjustment assembly. The container adjustment assembly is adjustably mounted to the support plate, opposite of the pair of hand shaped holders. The support plate, which functions as a platform for the pair of hand shaped holders and the container adjustment assembly, is connected to a chest portion of the bib so that the pair of hand shaped holders can be extended towards a neck loop of the bib. Consequently, the pair of hand shaped holders secures a container while the neck loop secures the bib the user's neck.

9 Claims, 6 Drawing Sheets

(56) References Cited

U.S. PATENT DOCUMENTS 5,135,189 A * 8/1992 Ghazizadeh ..... F16M 11/40 248/104
5,184,796 A * 2/1993 Maher ..... A61J 9/0669 248/104
5,217,192 A * 6/1993 Oktayuren ..... A63H 3/003 248/102
D345,423 S * 3/1994 Sabalones ..... D24/199
5,509,141 A * 4/1996 Saltzman ..... A41B 13/103 2/49.1
D381,082 S * 7/1997 Starner ..... D24/155
5,664,746 A * 9/1997 Benzakarya ..... A61J 9/0684 248/106
5,704,505 A * 1/1998 Singh ..... A61J 9/06 215/11.1
5,823,486 A * 10/1998 Smith ..... A61J 9/0692 248/104
6,003,821 A * 12/1999 Fabian ..... A61J 9/0607 248/104
6,098,934 A * 8/2000 Skelton ..... A61J 9/0638 248/102
6,386,490 B1 * 5/2002 Suh ..... A61J 9/0692 248/102
6,530,089 B2 * 3/2003 Frye ..... A41B 13/103 2/49.1
6,598,838 B2 * 7/2003 Suh ..... A61J 9/0692 248/102
6,745,399 B1 * 6/2004 Austin ..... A41B 13/103 2/49.1
6,923,332 B1 * 8/2005 Thomas ..... A61J 9/00 215/11.1
6,961,961 B1 * 11/2005 Ezra ..... A41B 13/10 2/49.1
6,986,487 B2 * 1/2006 Rich ..... A61J 9/0669 248/104
7,080,810 B2 * 7/2006 Munjed ..... A61J 9/0669 248/102
7,661,636 B1 * 2/2010 Burke ..... B60N 2/2845 248/102
8,118,268 B2 * 2/2012 Mabry ..... A47D 13/083 248/105
8,161,571 B1 * 4/2012 Beaupain ..... A41B 13/10 2/49.1
8,281,435 B2 * 10/2012 Kent ..... A61J 9/0638 5/655
10,179,092 B2 * 1/2019 Plavan ..... A61J 9/0638
10,337,666 B2 * 7/2019 Reitberger ..... F21V 21/0925
10,512,322 B2 * 12/2019 Washington ..... F16M 11/14
10,695,268 B2 * 6/2020 Holk ..... A61J 9/0669
2002/0162918 A1 * 11/2002 Suh ..... A61J 9/0692 248/104
2003/0186614 A1 * 10/2003 Taylor ..... A45F 5/00 446/26
2005/0000930 A1 * 1/2005 Weissberg ..... A61J 9/0607 215/11.6
2005/0103954 A1 5/2005 Touma
2006/0102810 A1 * 5/2006 Banks ..... A61J 9/0638 248/102
2007/0210219 A1 * 9/2007 Hiller ..... A61J 9/0607 248/102

* cited by examiner

HANDS-FREE ADJUSTABLE BIB FOR SECURING A CONTAINER

The current application is a 371 of international Patent Cooperation Treaty (PCT) application PCT/IB2017/054678 filed on Jul. 31, 2017. The PCT application PCT/IB2017/054678 claims a priority to the U.S. Provisional Patent application Ser. No. 62/368,399 filed on Jul. 29, 2016.

FIELD OF THE INVENTION

The present invention relates to a hands-free feeding apparatus. More specifically, the present invention is to hands-free adjustable bib that can uphold a variety of containers.

BACKGROUND OF THE INVENTION

Infant care and special needs people are a demanding task that requires a lot of patience and attention. For example, other than watching an infant at all times, the caregiver must tend to the infant's entertainment, hygiene, and feeding schedules. Playing with an infant and changing the diapers of an infant requires a lot of movement and toys or supplies. Feeding an infant or a special needs person however is one task that does not require as much physical movement. However, a caretaker must uphold or constantly bring the food or milk to the infant's mouth.

It is there for an objective of the present invention to provide a hands-free adjustable bib for securing a container as the present invention serves to lessen the amount of work while feeding an infant or a special needs person. The present invention upholds a container adjacent to user's mouth and eliminates the use of hands, wherein the container can be a beverage container, a baby bottle, a cup with a straw, and so on. More specifically, the present invention comprises a bib, a pair of hand shaped holders, and a container adjustment assembly. The bib functions as a traditional bib and secures around the user's neck. The pair of hand shaped holders is designed to secure the container and connected to the bib through the container adjustment assembly. The container adjustment assembly that is rotatable and flexible allows a responsible adult to properly adjust the container according to user's requirement, physical limitation, or physical capabilities. For example, the present invention may rest the beverage bottle on the infant's chest while the infant sips on the nipple of the baby bottle. Since the pair of hand shaped holders resembles a left human hand and a right human hand, the infant is more comfortable with the present invention even though the caretaker is not physically and continuously feeding the infant.

DETAIL DESCRIPTIONS OF THE INVENTION

All illustrations of the drawings are for the purpose of describing selected versions of the present invention and are not intended to limit the scope of the present invention.

Figure 1:
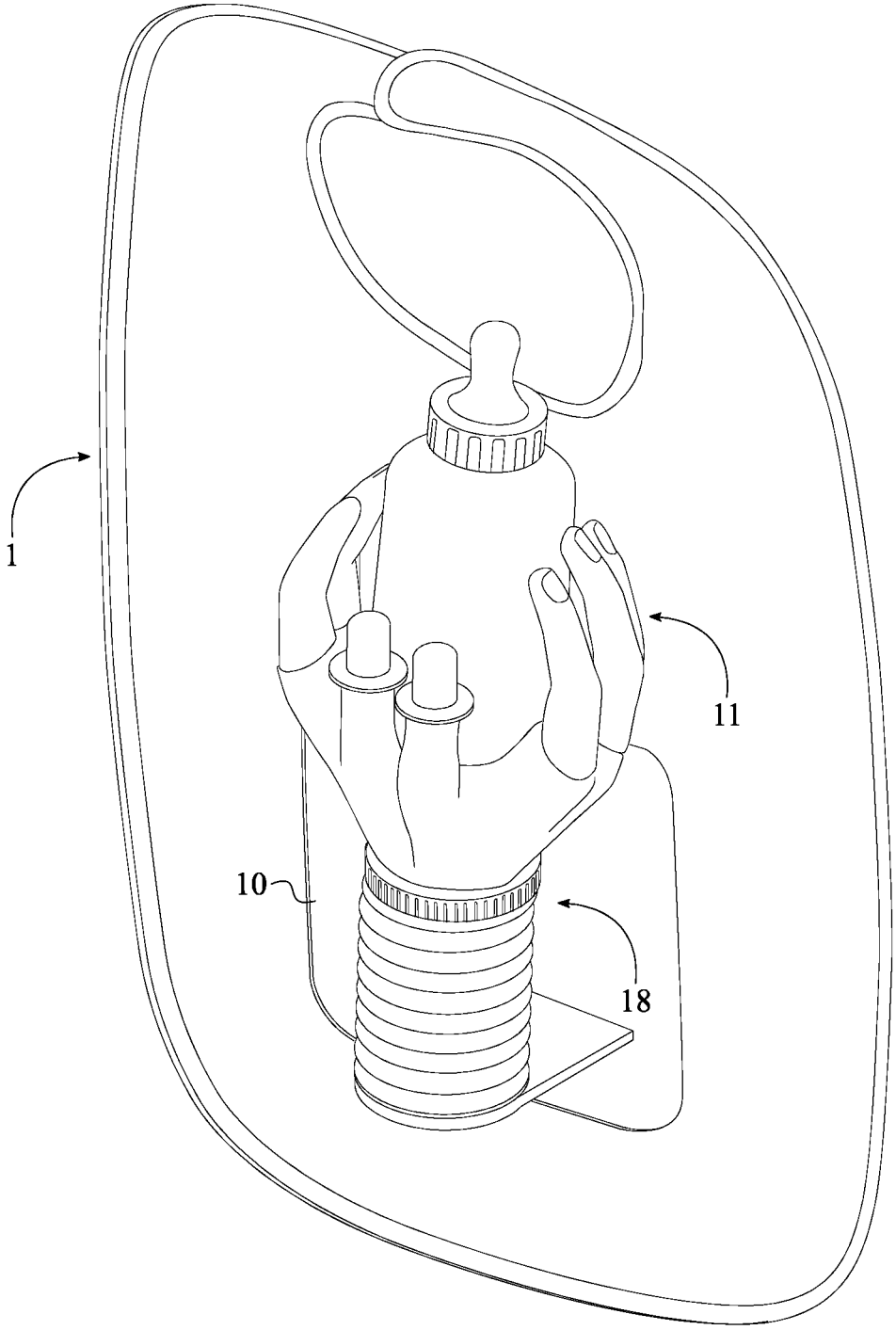
FIG. 1 is a front and top perspective view of the present invention in the closed configuration, wherein the container is secured to the pair of hand shaped holders.
Figure 4:
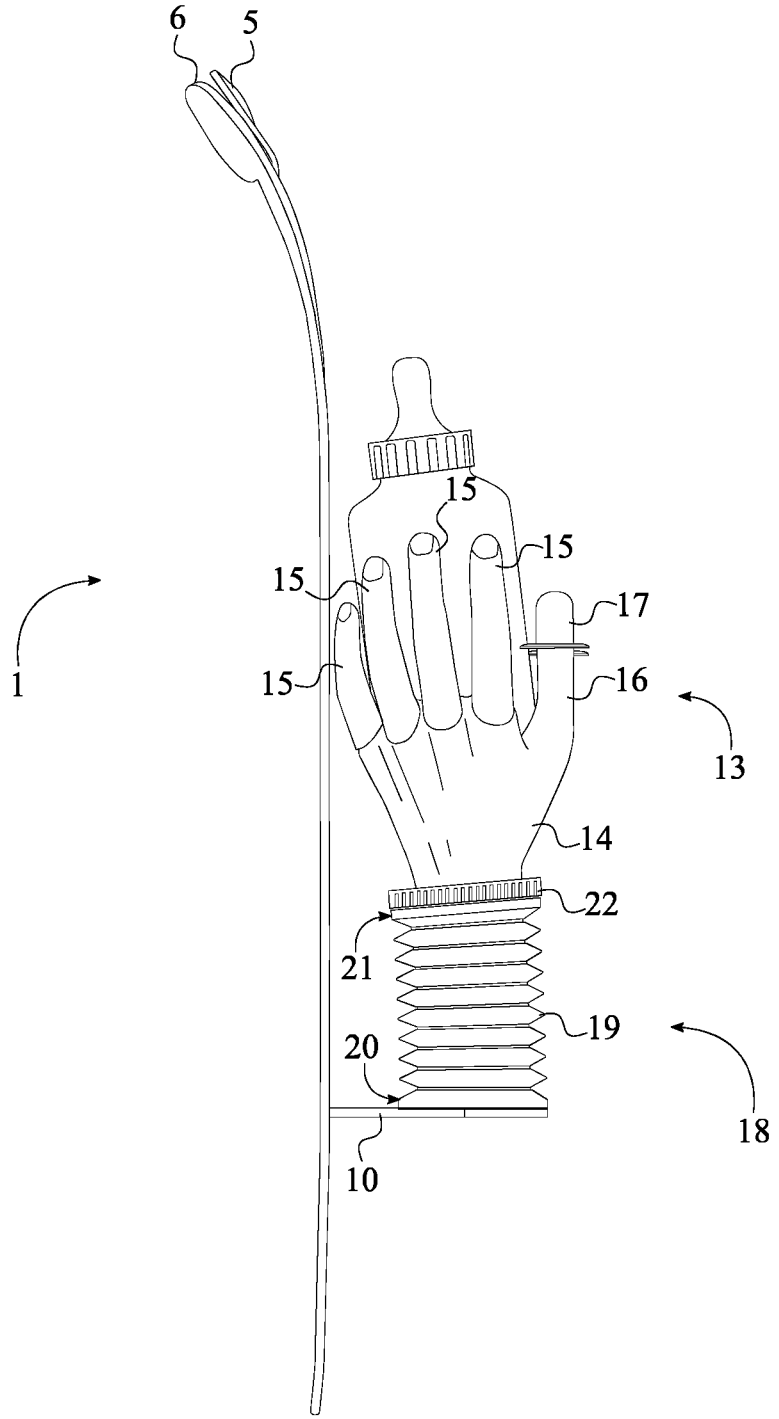
FIG. 4 is a side view of the present invention in the closed configuration, wherein the container is secured to the pair of hand shaped holders.

The present invention is a hands-free adjustable bib for securing a container, wherein the container can be a beverage container, a baby bottle, a cup with a straw, a juice box, a disposable food cup, and so on. The present invention is adjustably configured so that a responsible caretaker can properly secure the container to the present invention thus allowing a user to easily access stored food/beverage within the secured container. The present invention comprises a bib 1, a support plate 10, a pair of hand shaped holders 11, and a container adjustment assembly 18 as shown in FIG. 1 and FIG. 4. In reference to the general configuration of the present invention, the pair of hand shaped holders 11 is adjacently connected to a rotatable cap 22 of the container adjustment assembly 18. A flexible arm 19 of the container adjustment assembly 18 is adjustably mounted to the rotatable cap 22 and positioned opposite of the pair of hand shaped holders 11. The flexible arm 19 is adjustably mounted to the support plate 10, opposite of the rotatable cap 22. The support plate 10 is connected to a chest portion 2 of the bib 1 so that the pair of hand shaped holders 11 can be extended towards a neck loop 4 of the bib 1. Consequently, the pair of hand shaped holders 11 provides a platform to secure the container while the neck loop 4 of the bib 1 secures the present invention around the user's neck.

The bib 1, which functions similar to a traditional bib 1, provide a smooth and rigid surface area so that the support plate 10, the pair of hand shaped holders 11, and the container adjustment assembly 18 can be mounted. Additionally, the rigidness of the bib 1 provides solid surface area for the bib 1 so that the present invention is able to withstand the weight of the container and prevent the container from sliding while being utilized. In reference to FIG. 3, the chest portion 2 and the neck loop 4 are adjacently connected to each other thus delineating the overall shape of the bib 1. More specifically, the chest portion 2 and the neck loop 4 are arranged with one another like that of a traditional bib 1. The chest portion 2 covers the chest area of the user. The neck loop 4 wraps around the neck of the user and upholds the present invention beneath the user's face. In reference to FIG. 3, the neck loop 4 comprises a first interlocking strap 5 and a second interlocking strap 6. The first interlocking strap 5 and the second interlocking strap 6 are both extended from an upper edge of the chest portion 2. More specifically, the first interlocking strap 5 and the second interlocking strap 6 are positioned opposite of each other about the upper edge of the chest portion 2, adjacent a corresponding end of the upper edge of the chest portion 2.

Figure 3:
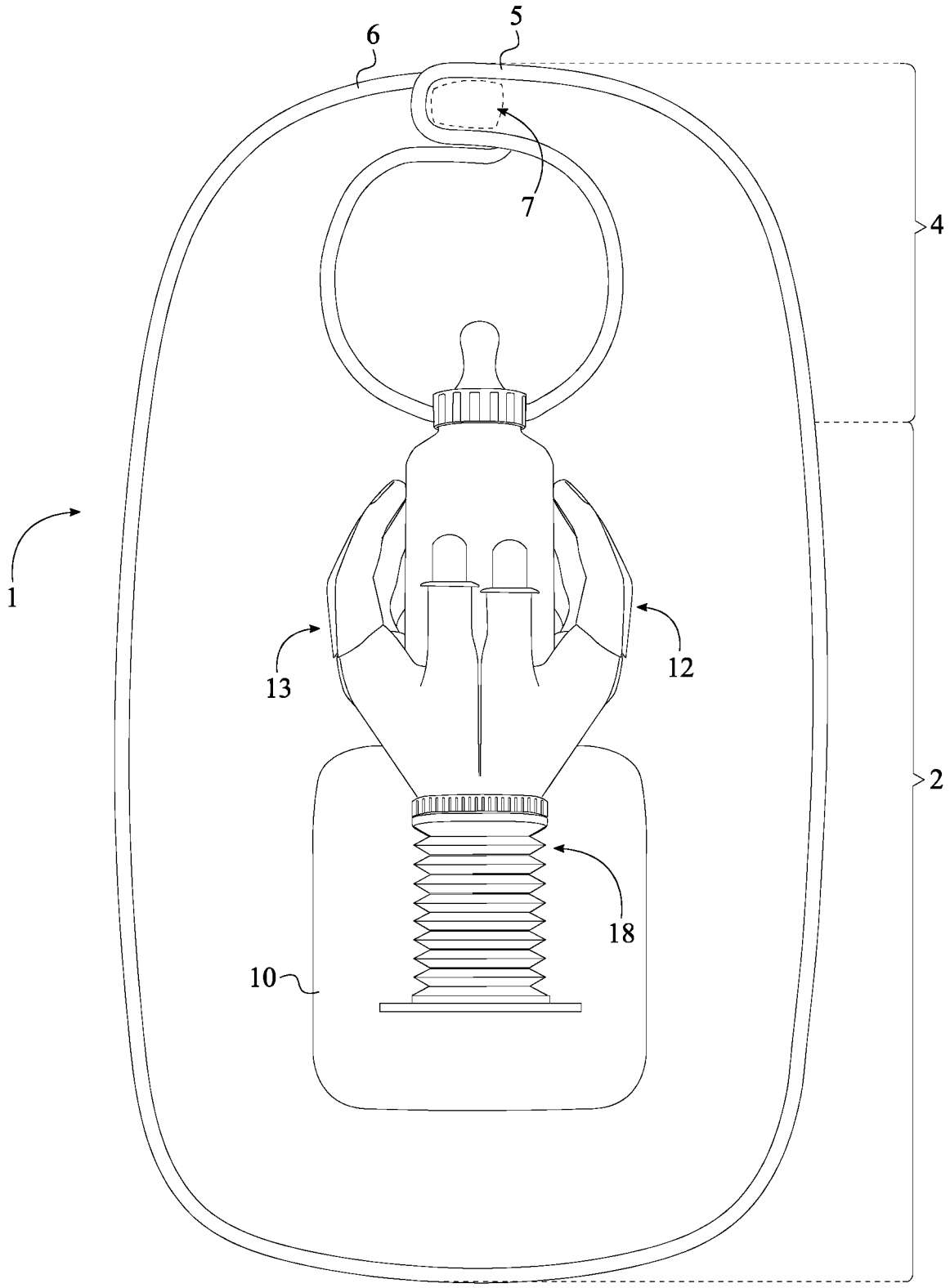
FIG. 3 is a front view of the present invention in the closed configuration, wherein the container is secured to the pair of hand shaped holders.
Figure 5:
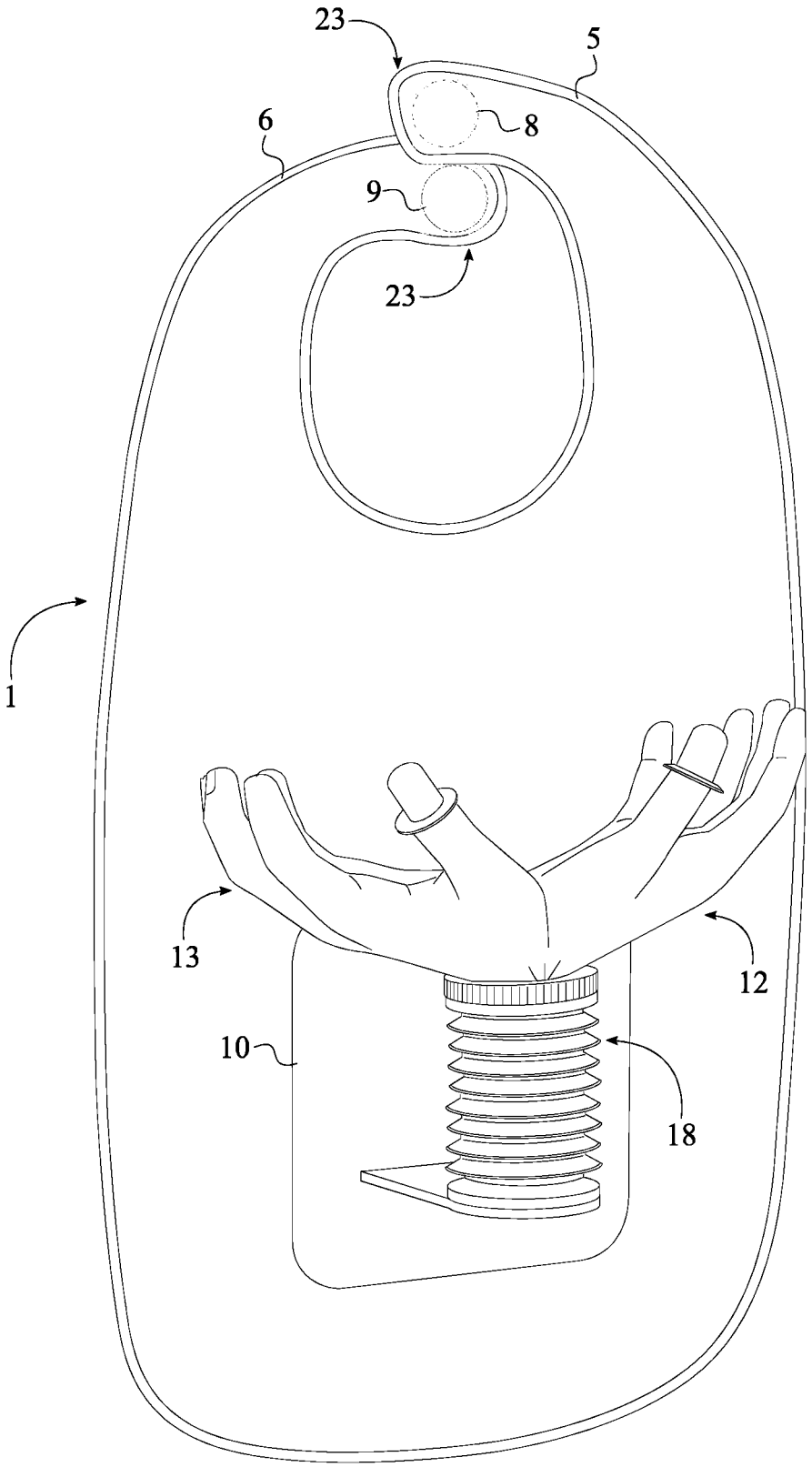
FIG. 5 is a front perspective view of the present invention in the opened configuration, without the container.

In reference to FIG. 3 and FIG. 5, a closure 7 is integrated into the neck loop 4 such that a distal end 23 of the first interlocking strap 5 and a distal end 23 of the second interlocking strap 6 are attached to each other by the closure 7. The closure 7 comprises a first fastener body 8 and a second fastener body 9 in order to complete the functionality of closure 7. More specifically, the first fastener body 8 is connected to the first interlocking strap 5. The second fastener body 9 is connected to the second interlocking strap 6. When the first fastener body 8 and the second fastener body 9 are attached to each other, the distal end 23 of the first interlocking strap 5 and the distal end 23 of the second interlocking strap 6 are consequently attached to each together. The preferred embodiment of the closure 7 is a hook and loop fastener. However, the closure 7 is not limited to the hook and loop fastener and can be any other types of quick detachable fasteners such as a snap button fastener, a magnetic fastener, and so on.

Figure 6:
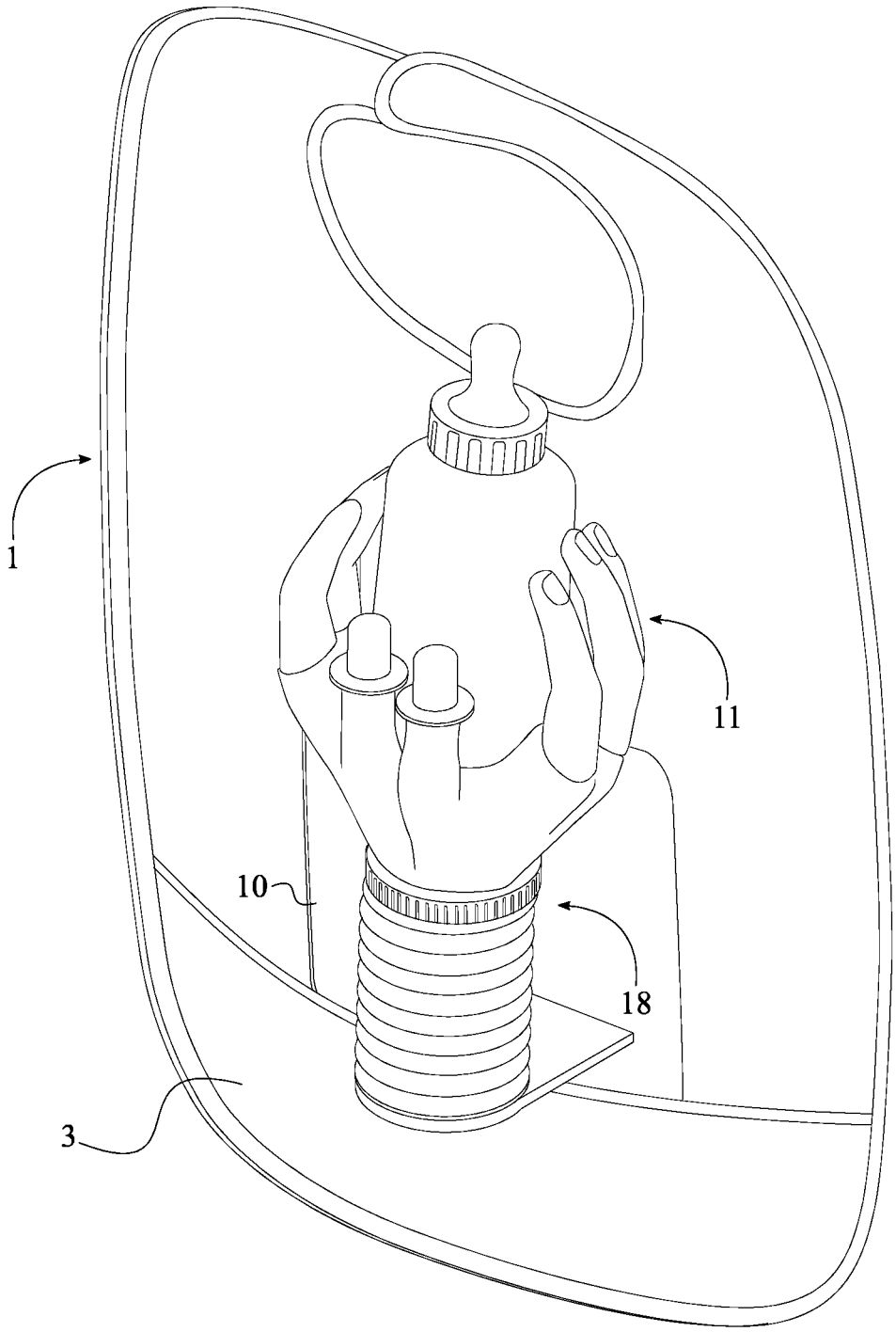
FIG. 6 is a front and top perspective view of the present invention in the closed configuration, wherein the container is secured to the pair of hand shaped holders and the pocket is connected to the bib.

The present invention further comprises a pocket 3 as seen in FIG. 6. The pocket 3 is adjacently positioned to the support plate 10 and positioned opposite of the neck loop 4 so that the pocket 3 can be connected to the chest portion 2. More specifically, the pocket 3 is positioned beneath the support plate 10 and the pair of hand shaped holders 11, wherein the pocket 3 catches the container if the container becomes dislodge from the pair of hand shaped holders 11. The pocket 3 may also catch food debris as well to maintain a clean surrounding.

Figure 2:
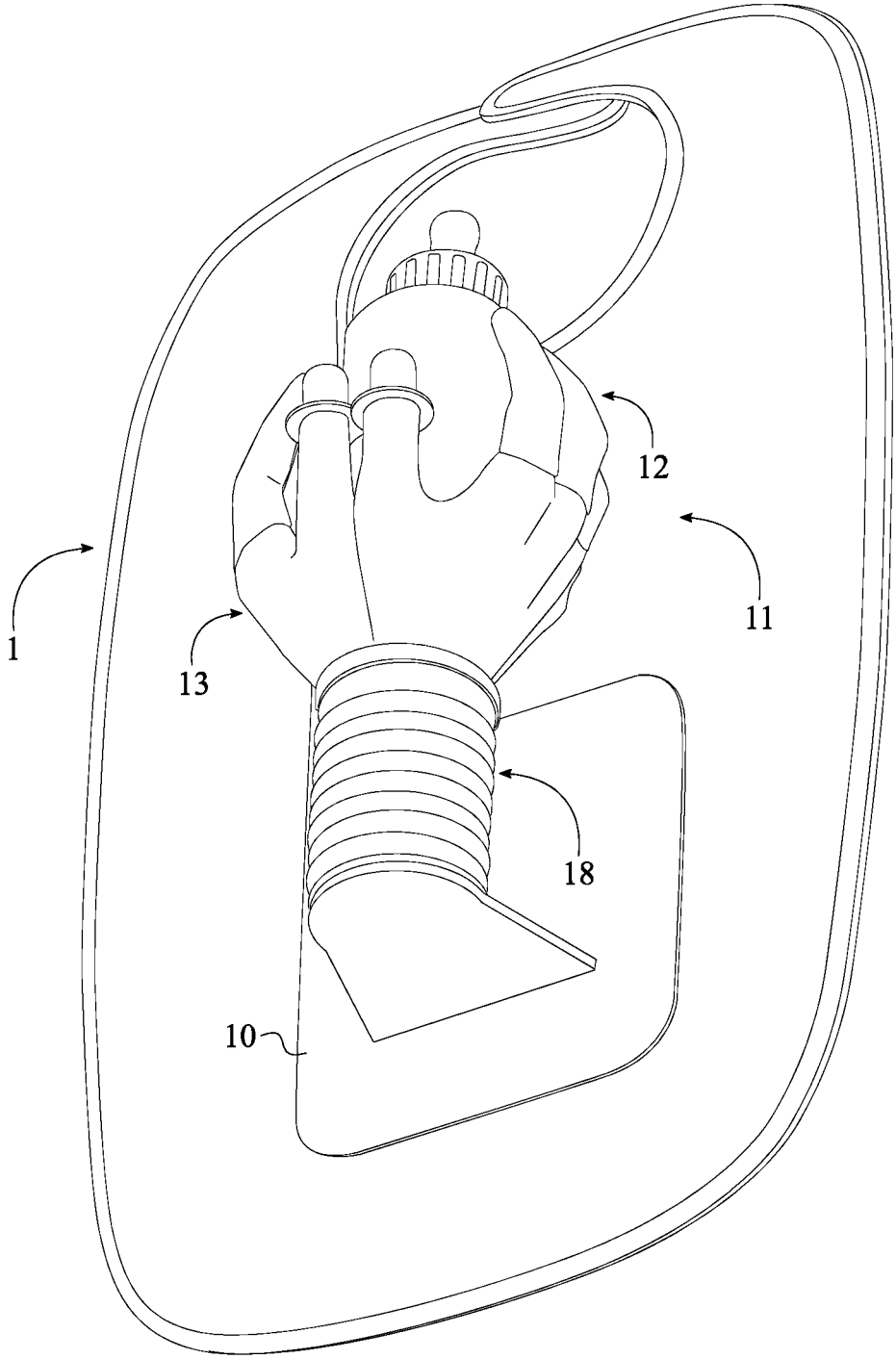
FIG. 2 is a front and bottom perspective view of the present invention in the closed configuration, wherein the container is secured to the pair of hand shaped holders.

The pair of hand shaped holders 11 that secures the container to the present invention comprises a first holder body 12 and a second holder body 13. In reference to FIG. 5-6, the first holder body 12 and the second holder body 13 are adjustably connected to the rotatable cap 22 so that the first holder body 12 and the second holder body 13 are able to reciprocally interchange in between an opened configuration and a closed configuration. The preferred embodiment for the pair of hand shaped holders 11 may comprise a structure that mirrors human hands, as seen in FIG. 1-2. As a result, the preferred embodiment for the pair of hand shaped holders 11 increases the comfortability of the user as it mimics actual human hands. Alternative embodiments of the pair of hand shaped holders 11 may include, but are not limited, to clamps, suction cups, and so on. The opened configuration and the closed configuration allow the first holder body 12 and the second holder body 13 to accommodate a variety of containers that may vary in height, width, and shape. When a placement opening between the first holder body 12 and the second holder body 13 allows a caretaker to position the container within the pair of hand shaped holders 11, the present invention delineates the opened configuration in which the placement opening is easily attained by pulling apart the first holder body 12 and the second holder body 13. When the placement opening between the first holder body 12 and the second holder body 13 reverts back to its neutral position and secures the container with the pair of hand shaped holders 11, the present invention delineates the closed configuration as the first holder body 12 and the second holder body 13 are free of any external forces.

The first holder body 12 and the second holder body 13 each comprise a palm shaped section 14, a plurality of teething fingers 15, a thumb shaped section 16, and a pacifier section 17. More specifically, the plurality of teething fingers 15 represents the fore finger, the middle finger, the ring finger, and the little finger of the human hand. The plurality of teething fingers 15 functions as a soothing teether for teething infants. The thumb shaped section 16 represents the thumb finger of the human hand. In reference to FIG. 4, the plurality of teething fingers 15 and the thumb shaped section 16 are connected to the palm shaped section 14. The pacifier section 17 is terminally attached to the thumb shaped section 16. As a result of the removable attachment between the pacifier section 17 and the thumb shaped section 16, the pacifier section 17 can be integrated or removed from the present invention upon the caretaker's preference.

The support plate 10 allows movement and position of the pair of hand shaped holders 11 and the container adjustment assembly 18 within the present invention. More specifically, the support plate 10 is secured to the chest portion 2 by a variety of fasteners such as a seam, an adhesive, button fasteners, and so on. The support plate 10 comprises a front surface and a rear surface, wherein the front surface is positioned opposite of the rear surface. In reference to FIG. 3, the rear surface of the support plate 10 is adjacently positioned with the chest portion 2 so that the front surface of the support plate 10 can be adjacently positioned with the container adjustment assembly 18 and the pair of hand shaped holders 11. As a result, the support plate 10 provides a rigid platform for the container adjustment assembly 18 and the pair of hand shaped holders 11 so that the container can be secured to the present invention.

The rotatable cap 22 that is connected with the pair of hand shaped holders 11 allows proper placement of the container within the present invention. In reference to FIG. 4, the rotatable cap 22 is adjacently connected to a free end 21 of the flexible arm 19 while a fixed end 20 of the flexible arm 19 is adjacently connected to the support plate 10. Additionally, the free end 21 of the of the flexible arm 19 is configured to extend and retract from the fixed end 20 of the flexible arm 19. As a result, when the container is secured within the pair of hand shaped holders 11, the container can be positioned adjacent to the user mouth by adjusting the distance between the pair of hand shaped holders 11 and the support plate 10. Furthermore, the free end 21 of the flexible arm 19 is configured to bend about the fixed end 20 thus providing 360 degrees of flexibility for the container. As a result, the caretaker can properly align the container depending upon the types of foods, such as liquid or solid. For example, since the flexible arm 19 and the rotatable cap 22 can accommodate variety of angles within the present invention, the pair of hand shaped holders 11 allows the caretaker to position and accommodate variety of feeding angles for the container.

In order to properly use the present invention, the caretaker simply wraps the neck loop 4 around the user's neck in such a way that the first interlocking strap 5 is secured to the second interlocking strap 6 via the closure 7. The pair of hand shaped holders 11 is then transformed into the opened configuration from the closed configuration that is also known as the neutral position. Consequently, the container is secured within the pair of hand shaped holders 11 by transferring the pair of hand shaped holders 11 into the closed configuration from the opened configuration. The flexible arm 19 and the rotatable cap 22 are then adjusted according to the user's preference and at an optimal feeding angle so that the container can be comfortably upheld adjacent the mouth of the user who is wearing the present invention.

Although the invention has been explained in relation to its preferred embodiment, it is to be understood that many other possible modifications and variations can be made without departing from the spirit and scope of the invention as hereinafter claimed.

What is claimed is:

1. A hands-free adjustable bib for securing a container comprises:

a bib;

a support plate;

a pair of hand shaped holders;

a container adjustment assembly;

the container adjustment assembly comprises a flexible arm and a rotatable cap;

the pair of hand shaped holders being adjacently connected to the rotatable cap;

the flexible arm being adjustably mounted to the rotatable cap, opposite of the pair of hand shaped holders;

the flexible arm being adjustably mounted to the support plate, opposite of the rotatable cap;

the support plate being connected to a chest portion of the bib;

the pair of hand shaped holders being extended towards a neck loop of the bib;

the pair of hand shaped holders comprises a first holder body and a second holder body;

the first holder body and the second holder body each comprise a palm shaped section, a plurality of teething fingers, a thumb shaped section, and a pacifier section;

the plurality of teething fingers and the thumb shaped section being connected to the palm shaped section; and the pacifier section being terminally attached to the thumb shaped section.

2. The hands-free adjustable bib for securing a container as claimed in claim 1 comprises:

the first holder body and the second holder body being adjustably connected to the rotatable cap; and the first holder body and the second holder body being reciprocally interchanged in between an opened configuration and a closed configuration.

3. The hands-free adjustable bib for securing a container as claimed in claim 1 comprises:

the flexible arm comprises a fixed end and a free end;

the fixed end being adjacently connected to the support plate; and the rotatable cap is adjacently connected to the free end.

4. The hands-free adjustable bib for securing a container as claimed in claim 3, wherein the free end is configured to extend and retract from the fixed end.

5. The hands-free adjustable bib for securing a container as claimed in claim 3, wherein the free end is configured to bend about the fixed end.

6. The hands-free adjustable bib for securing a container as claimed in claim 1, wherein the chest portion and the neck loop being adjacently connected to each other.

7. The hands-free adjustable bib for securing a container as claimed in claim 1 comprises:

the neck loop comprises a first interlocking strap and a second interlocking strap; and a distal end of the first interlocking strap and a distal end of the second interlocking strap being attached to each other by a closure.

8. The hands-free adjustable bib for securing a container as claimed in claim 7 comprises:

the closure comprises a first fastener body and a second fastener body;

the first fastener body being connected to the first interlocking strap;

the second fastener body being connected to the second interlocking strap; and the first fastener body and the second fastener body being attached to each other.

9. The hands-free adjustable bib for securing a container as claimed in claim 7 comprises:

a pocket;

the pocket being adjacently positioned to the support plate, opposite of the neck loop; and the pocket being connected to the chest portion.

* * * * *